US007359656B2

(12) United States Patent
Song

(10) Patent No.: US 7,359,656 B2
(45) Date of Patent: Apr. 15, 2008

(54) IMAGE FORMING APPARATUS HAVING GUIDE UNIT

(75) Inventor: Gwan-seob Song, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 121 days.

(21) Appl. No.: 11/376,437

(22) Filed: Mar. 16, 2006

(65) Prior Publication Data

US 2006/0210302 A1 Sep. 21, 2006

(30) Foreign Application Priority Data

Mar. 21, 2005 (KR) ..... 10-2005-0023089

(51) Int. Cl.
*G03G 21/18* (2006.01)

(52) U.S. Cl. ..... 399/110; 399/111; 399/125

(58) Field of Classification Search ..... 399/107, 399/110, 111, 125; 347/138, 152
See application file for complete search history.

(56) References Cited

U.S. PATENT DOCUMENTS

| | | | | |
|---|---|---|---|---|
| 6,085,051 | A * | 7/2000 | Miyasaka et al. | 399/110 |
| 6,665,047 | B1 * | 12/2003 | Kimura et al. | 399/107 X |
| 6,678,490 | B2 * | 1/2004 | Tanaka | 399/125 X |
| 7,139,507 | B2 * | 11/2006 | Sugimura et al. | 399/111 |
| 2005/0232653 | A1 * | 10/2005 | Murooka | 399/92 |
| 2006/0140669 | A1 * | 6/2006 | Sato | 399/110 |
| 2006/0159486 | A1 * | 7/2006 | Kweon | 399/110 |

FOREIGN PATENT DOCUMENTS

| | | |
|---|---|---|
| JP | 2-101482 | 4/1990 |
| JP | 5-261991 | 10/1993 |
| JP | 8-220824 | 8/1996 |
| JP | 2000-155517 | 6/2000 |
| JP | 2004-117989 | 4/2004 |
| KR | 2002-73448 | 9/2002 |

OTHER PUBLICATIONS

Office Action Issued in Korean Patent Application No. 2005-23089 on Jul. 21, 2006.

* cited by examiner

*Primary Examiner*—Sophia S. Chen
(74) *Attorney, Agent, or Firm*—Stein, McEwen & Bui, LLP

(57) ABSTRACT

Disclosed is an image forming apparatus in which a mount location of a developing unit being mounted on a main body of the apparatus is aligned in advance so that the developing unit smoothly enters the main body. For this purpose, a recording medium feed cover opens and closes the opening, the recording medium feed cover including a top surface on which the recording medium is stacked. A recording medium cover covers the recording medium stacked on the recording medium feed cover, and a guide unit, provided on the recording medium cover, guides a mounting location of the developing unit.

21 Claims, 10 Drawing Sheets

IMAGE FORMING APPARATUS HAVING GUIDE UNIT

CROSS-REFERENCE TO RELATED APPLICATION

This application claims benefit under 35 U.S.C. § 119 from Korean Patent Application No. 2005-23089, filed on Mar. 21, 2005 in the Korean Intellectual Property Office, the disclosure of which is incorporated herein by reference.

BACKGROUND OF THE INVENTION

1. Field of the Invention

An aspect of the present invention relates to an image forming apparatus, and, more specifically, the invention relates to an image forming apparatus on which a developing unit may be relatively easily mounted.

2. Description of the Related Art

Generally, an electro-photographic image forming apparatus, such as a laser beam printer, is an apparatus that forms an electrostatic latent image on a photosensitive medium such as a photosensitive drum or a photosensitive belt, and obtains a desired image by developing the electrostatic latent image with a certain colored developer and transcribing that electrostatic latent image onto a recording medium. Meanwhile, in recent image forming apparatuses, reductions in apparatus sizes and decreases in medium costs have been possible where a cover is opened in order to be used as a paper feeding plate instead of a cassette-type recording medium feed cover.

FIG. 1 is a schematic view showing a developing unit mounting structure of a conventional image forming apparatus, and FIG. 2 is a perspective view explaining a developing unit mounting structure of a conventional image forming apparatus. Referring to FIGS. 1 and 2, an image forming apparatus is shown as comprising a main body 1, a cover 3, and a developing unit 5. One end portion of the cover 3 is coupled, in a pivoting manner, to one side surface of the main body 1 so that an opening la is opened and closed. The cover 3 is configured to be able to supply recording media as well by allowing for a stacking of recording media on the top surface thereof while the cover 3 is opened. Hereafter, the cover is called a "recording medium feed cover". A stopper 7 to align recording media in a lengthwise direction thereof is installed on the top of the recording medium feed cover 3 in order to move rectilinearly along the direction of the X-axis of FIGS. 1 and 2. In addition, recording medium width guides 9 to align recording media in the widthwise direction thereof are installed at both sides within the main body 1 so as to move rectilinearly along the direction of the Y-axis of FIGS. 1 and 2. Here, a recording medium cover 11 is installed in order to prevent foreign particles from falling on recording media when the recording medium feed cover 3 is opened and recording media are stacked.

The developing unit 5 to form images on the recording media supplied from the recording medium feed cover 3 is formed with a cartridge 5*a* that has a toner container containing a large amount of toner and a developing chamber to form images on the supplied recording media using the toner transferred from the toner container. Generally, a photosensitive medium (not shown) that rotates at a certain speed is installed inside the developing chamber, and a charging roller (not shown) to charge the surface of the photosensitive medium with a certain voltage is installed at one side of the photosensitive medium. In addition, at the other side of the photosensitive medium, a developing roller (not shown) is installed to apply toner on the surface of the photosensitive medium where an electrostatic latent image is formed and to develop the electrostatic latent image into a visible image.

As is described above, the developing unit 5 is integrated into one cartridge 5*a*. Accordingly, when the cartridge is used up and needs to be replaced with a new cartridge, or when jammed paper is removed, users may replace the cartridge themselves. A handle 5*b* is formed at one end of the cartridge 5*a* so that the cartridge may be easily mounted. Here, guide rails 1*b* to guide the transfer of the developing unit 5 are formed at both sides within the main body 1 in order to allow for a replacement of the developing unit 5, and guide projections 5*d* are formed at both sides of the developing unit 5 to cooperate with the guide rails 1*b*.

When a user replaces the developing unit 5 or removes jammed recording media, the user opens the opening 1*a* of the main body 1 by opening the recording medium feed cover 3, and holds the handle 5*b* of the developing unit 5 and thereby pulls the developing unit 5 out of the main body 1. Thereafter, when a new developing unit 5 is mounted, or when the existing developing unit is put back into an original position thereof, after a removal of the jammed recording media, as shown in FIG. 1, the guide projections provided at both sides of the developing unit 5 are set on the guide rails 1*b*, and the developing unit 5 is pushed inside the main body 1.

However, at this point, in a case where a user does not correctly set the guide projections 5*d* to the guide rails 1*b*, the developing unit 5 cannot be mounted correctly. On the other hand, even if the developing unit is mounted by force, normal printing operations cannot be performed.

SUMMARY OF THE INVENTION

Aspects of the present invention solve the above and/or other drawbacks in the related art. An aspect of the invention provides an image forming apparatus in which a mount location of a developing unit is guided so that the developing unit may be easily mounted.

According to one aspect of the invention, there is provided an image forming apparatus to form an image on a recording medium transferred through the apparatus, comprising: a main body to define an opening; a developing unit to be mounted into and dismounted from the main body through the opening, to form the image on the recording medium; a recording medium feed cover to open and close the opening, the recording medium feed cover comprising a top surface on which the recording medium is stacked; a recording medium cover to cover the recording medium stacked on the recording medium feed cover; and a guide unit, provided on the recording medium cover, to guide a mounting location of the developing unit.

The guide unit may include at least one guide rib that is in contact with the bottom surface of the developing unit, the guide rib being formed at both sides of the top surface of the recording medium cover. The guide rib has a shape corresponding to the bottom surface of the developing unit.

According to another aspect of the invention, there is provided an image forming apparatus to form an image on a recording medium transferred through the apparatus, comprising: a main body to define an opening an opening; a developing unit to be mounted into and dismounted from the main body through the opening, to form the image on the recording medium; a recording medium feed cover to open and close the opening, the recording medium feed cover comprising a top surface on which the recording medium is stacked; a recording medium width guide, installed on at least one interior side of the main body, to align the recording medium widthwise; and a guide unit, installed at the recording medium width guide, to guide a mounting location of the developing unit.

The guide unit comprises a guide bar that is installed at the upper portion of the recording medium width guide to guide the movement of the developing unit. The guide bar is installed so as to be elastically pressed by an elastic member in order to be pushed outside the main body when the recording medium feed cover is opened. The elastic member may be a coil spring. The top surface of the guide bar is formed so as to correspond to the bottom surface of the developing unit.

According to another aspect of the invention, there is provided an image forming apparatus to form an image on a recording medium transferred through the apparatus, comprising: a main body to define an opening; a developing unit to be mounted into and dismounted from the main body through the opening, to form the image on the recording medium; a recording medium feeding unit to feed the recording medium toward the developing unit; and a guide unit, installed at the recording medium width guide, to guide a mounting location of the developing unit.

According to another aspect of the invention, there is provided an image forming apparatus to form an image on a recording medium transferred through the apparatus, comprising: a main body to define an opening; a developing unit to be mounted into and dismounted from the main body through the opening, to form the image on the recording medium; a recording medium feed cover to open and close the opening, the recording medium feed cover comprising a top surface on which the recording medium is stacked; and a guide unit, installed outside the main body, to guide a mounting location of the developing unit.

According to another aspect of the invention, there is provided an image forming apparatus to form an image on a recording medium transferred through the apparatus, comprising: a main body to define an opening; a developing unit to be mounted into and dismounted from the main body through the opening, to form the image on the recording medium; a recording medium feed cover to open and close the opening, the recording medium feed cover comprising a top surface on which the recording medium is stacked; and a guide unit, installed so as to be selectively protruded from the inside to the outside of the main body, to guide a mounting location of the developing unit.

In the configurations described above, the guide unit may be detachably installed.

Where a developing unit is detached from a main body and attached again to the main body, the image forming apparatus of the invention configured as described above is advantageous in that the developing unit may be correctly aligned to the mount location and transferred into the main body.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
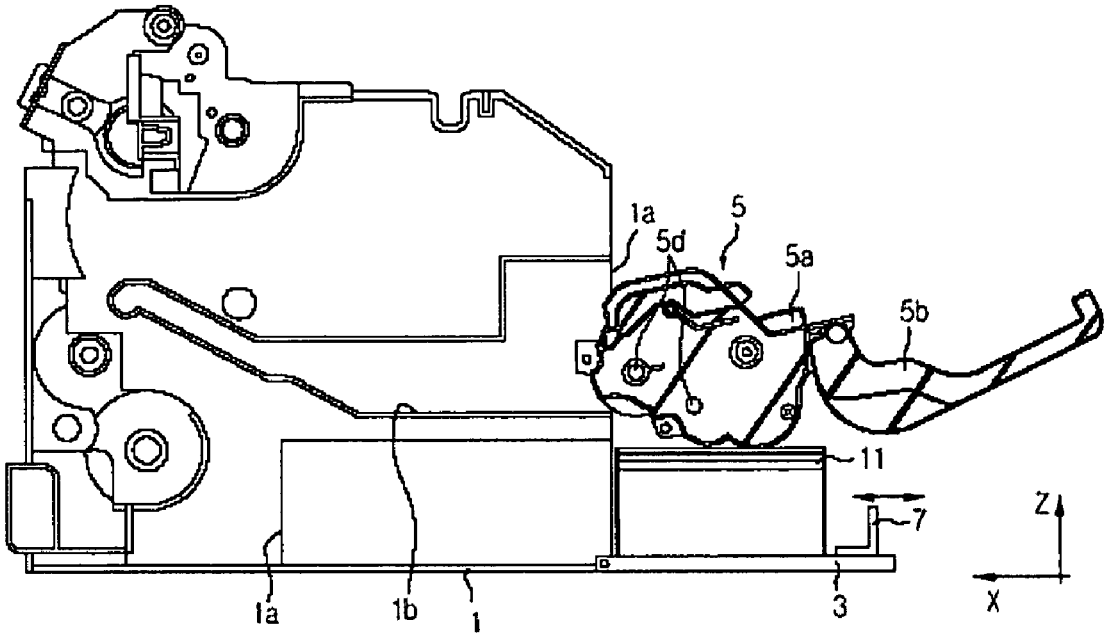
FIG. 1 (PRIOR ART)
FIG. 1 is a schematic view showing a developing unit mounting structure of a conventional image forming apparatus.
Figure 2:
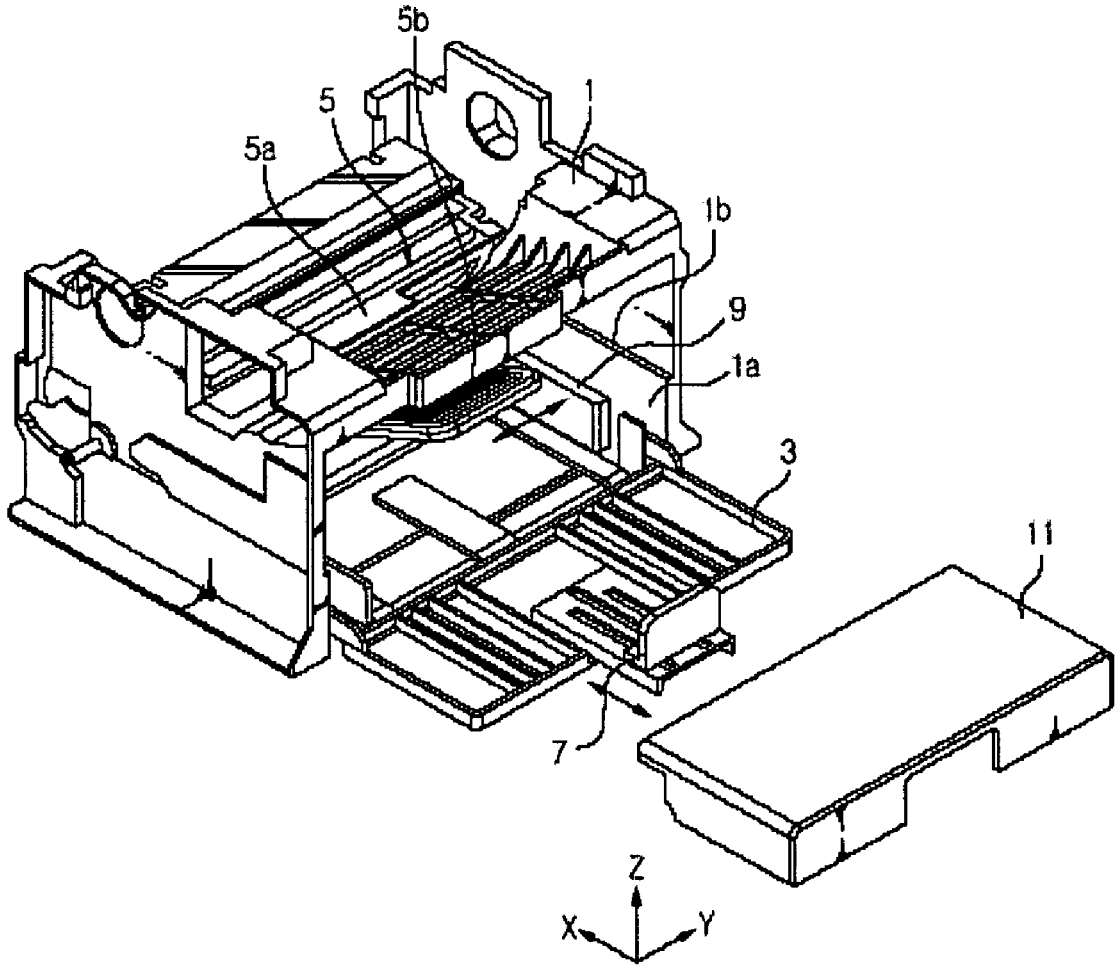
FIG. 2 (PRIOR ART)
FIG. 2 is a perspective view explaining a developing unit mounting structure of a conventional image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
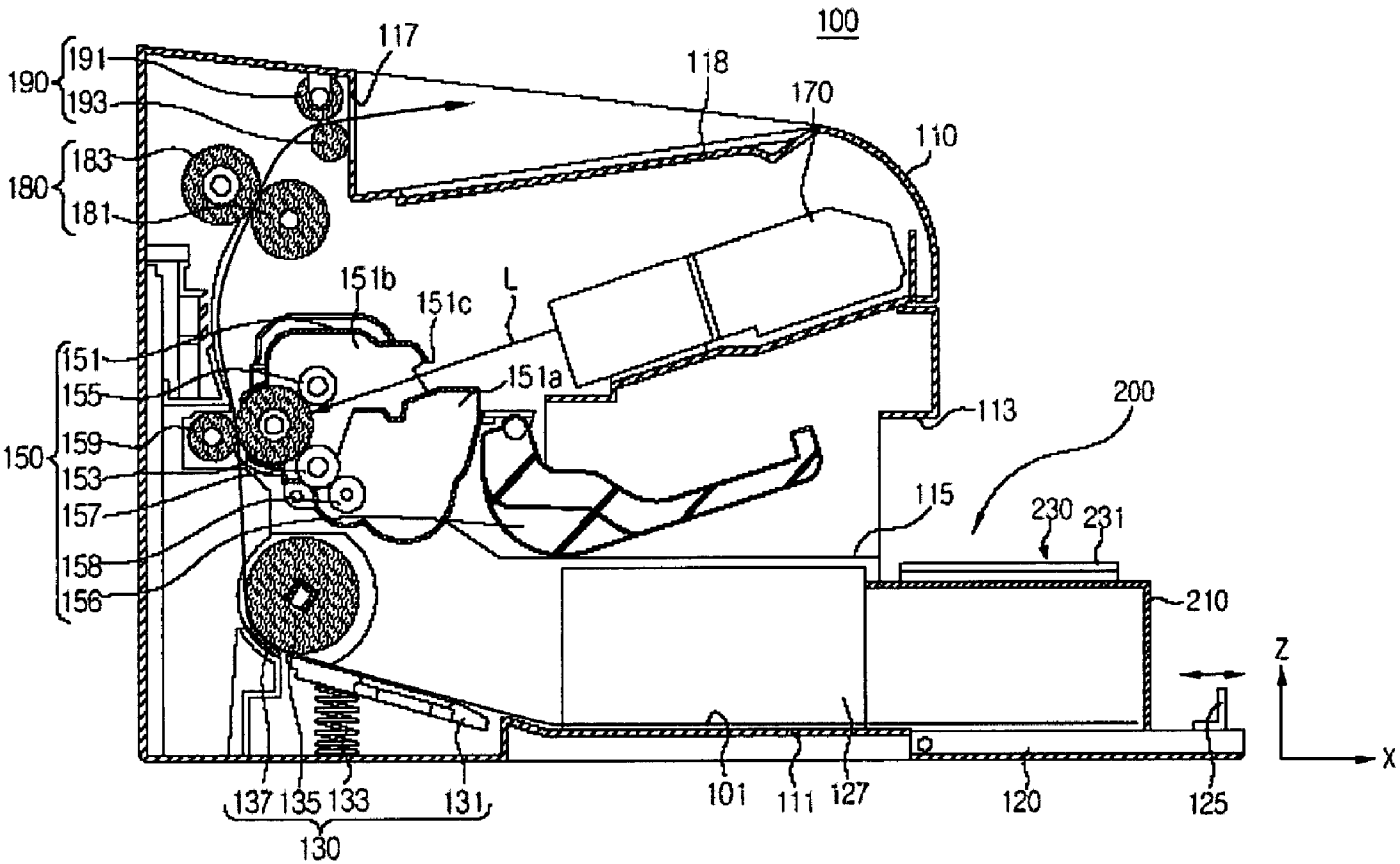
FIG. 3 is a schematic view showing a configuration of an image forming apparatus according to an embodiment of the invention.
Figure 4:
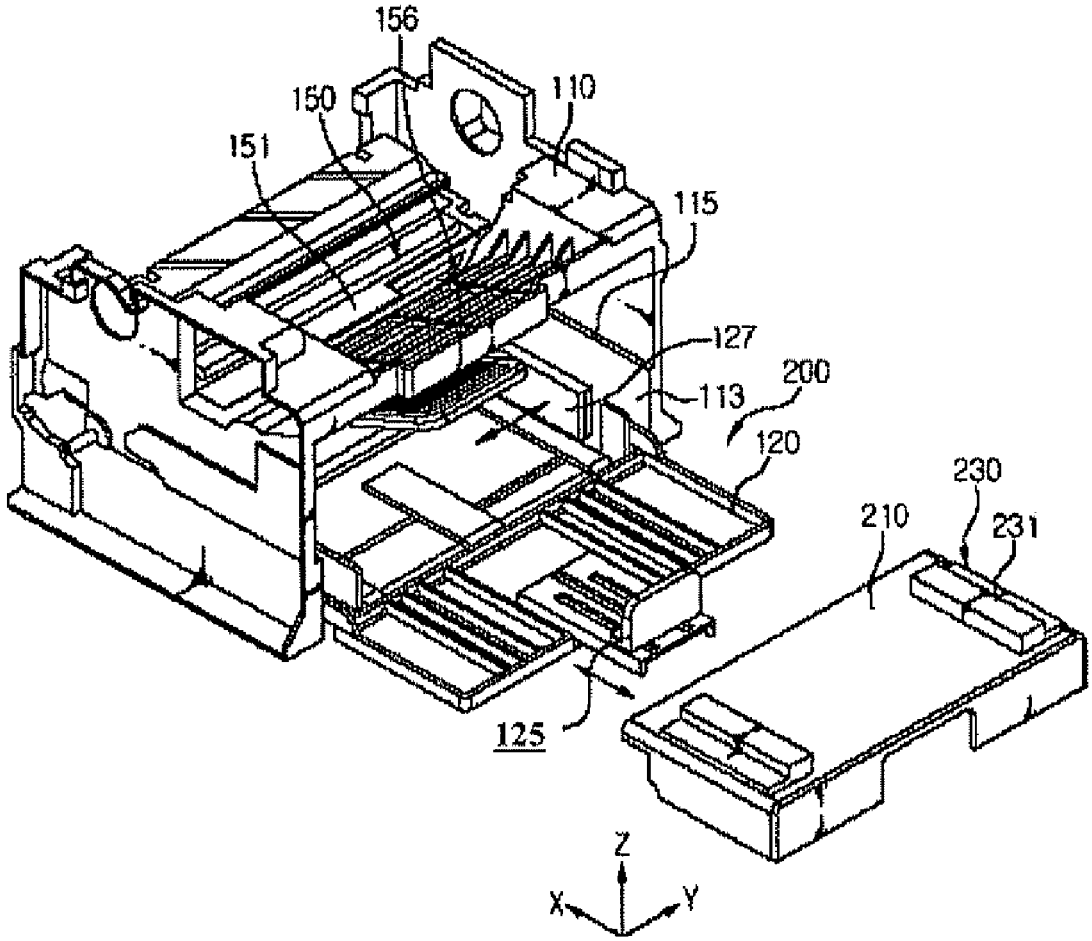
FIG. 4 is a perspective view schematically showing a configuration of an image forming apparatus according to an embodiment of the invention.

FIG. 3 is a schematic view showing a configuration of an image forming apparatus according to one embodiment of the invention, and FIG. 4 is a perspective view schematically showing a configuration of the image forming apparatus. As shown in FIGS. 3 and 4, an image forming apparatus 100 comprises a main body 110, a recording medium supplying unit 130, a developing unit 150, a laser beam scanning unit 170, a fixing unit 180, a recording medium ejecting unit 190, and a recording medium feeding unit 200. The recording medium feeding unit 200 includes a recording medium supply plate 111 provided at the bottom of the main body 110, and a recording medium feed cover 120 that opens and closes an opening 113 of the main body 110, the top surface of which forms a horizontal surface together with the top surface of the recording medium supply plate 111. A recording medium 101, such as paper, may be stacked on a top surface of the recording media feed cover 120 when the recording medium feed cover 120 is opened with a portion thereof protruding outwardly from the main body 110. A stopper 125 to align the end portion of the recording medium with end portions of other recording media in the lengthwise direction is formed on the recording medium feed cover 120 so as to linearly reciprocate along the X-axis. On the other hand, a recording medium width guide 127 to align the recording medium 101 by itself and with other recording media in the widthwise direction is formed at both sides within the main body 110.

In addition, a recording medium cover 210 is installed to prevent foreign particles from falling onto the recording medium 101 when the recording medium 101 is stacked on the recording medium feed cover 120. The recording medium cover 210 is placed on the recording medium feed cover 120, and, when the recording medium 101 is stacked thereon, a user holds the recording medium cover 210 up above the recording medium feed cover 120 in order to make room to stack the recording medium 101. A guide rib 231 is installed above the recording medium feed cover 120 as a guide unit 230 to guide the attachment and detachment of the developing unit 150 to and from the main body 110 of the apparatus. The guide rib 231 contacts the bottom surface of a cartridge 151 that forms the developing unit 150 and guides the mount location of the developing unit 150, and will be explained below in detail with reference to FIGS. 5 to 6C.

A recording medium-ejecting slit 117 is formed at the upper portion of the main body 110 through which the recording medium, being fixed with images through the fixing unit 180, is ejected, and a recording medium ejection tray 118, on which the recording medium, ejected through the recording medium -ejecting slit 117, is stacked.

The recording medium supplying unit 130 supplies a plurality of sheets of the recording medium 101 to the developing unit 150. The recording medium supplying unit 130 includes a knock up plate 131 at the recording medium supply plate 111 that supports a plurality sheets of recording medium 101, and a press spring 133 installed beneath the knock up plate 131 that elastically supports the knock up plate 131 in an upward direction. In addition, the recording medium supplying unit 130 includes a pickup roller 135 to pick up the recording medium 101 that is stacked on the knock up plate 131, and a friction pad 137 installed so as to be in contact with the pickup roller 135 that provides a friction force needed to individually separate the recording medium 101 from other recording media.

The developing unit 150 to form images on the recording medium 101 is formed with a cartridge 151 that includes a toner container 151*a* containing a large amount of toner, and a developing chamber 151*b* to form images on the supplied recording medium using the toner transferred from the toner container. A photosensitive medium 153 that rotates at a certain speed is installed inside the developing chamber 151*b*, a portion of which protrudes outward from the cartridge 151. A charging roller 155 to charge the surface of the photosensitive medium 153 with a certain voltage is installed at one side of the photosensitive medium 153. A developing roller 157 to attach toner to the surface of the photosensitive medium 153, where an electrostatic latent image is formed, is installed at the other side the photosensitive medium 153. A supplying roller 158 to supply toner to the developing roller 157 is installed at the other side of the developing roller 158. A transcribing roller 159 to transcribe an image that is formed on the photosensitive medium 153 onto the recording medium 101 that is supplied through the pickup roller 135 is additionally installed in order to be pressed with a certain pressure against the photosensitive medium 153 that protrudes outward from the cartridge 151.

Here, an example of a photosensitive medium 153 that is integrated inside a cartridge 151 is explained. However, it is also noted that a photosensitive medium 153 may be separately configured outside the cartridge 151. On the other hand, a handle 156 is installed at one side of the cartridge 151 so that a user may relatively easily dismount the cartridge 151 from the main body 110, or put a cartridge into the main body 110.

The laser beam scanning unit 170 is installed at one side of the cartridge 151 to scan a certain light, such as a laser beam L that is needed to form an image on the outer surface of the photosensitive medium 153, and to form an electrostatic latent image on the surface of the photosensitive medium 153. At this point, the cartridge 151 forms a light inlet 151*c* in order to allow the light irradiated from the laser beam scanning unit 170 to pass through the cartridge 151.

The fixing unit 180, which heats up the recording medium 101 onto which a toner image is transcribed through the transcribing roller 159, and fixes the toner image in a powder state to the recording medium 101, includes a heating roller 181 that comprises a heating source such as an internal halogen lamp, and a pressing roller 183 that is biased to contact the heating roller 181 with a certain pressure.

The recording medium-ejecting unit 190 to eject recording media 101 through the recording medium-ejecting slit 117 of the main body 110, includes a recording medium-ejecting roller 191 and a recording medium-ejecting idle roller 193 that rotates while in contact with the recording medium-ejecting roller 191.

The image forming apparatus 100 configured as described above is configured so as to allow for a dismounting and a mounting of a developing unit 150 when developer within the developing unit 150 is used up, or when the recording medium 101 is jammed. The recording medium feeding unit 200 is provided with a guide unit to guide the mounting location of the developing unit 150.

First Embodiment 1

Figure 5:
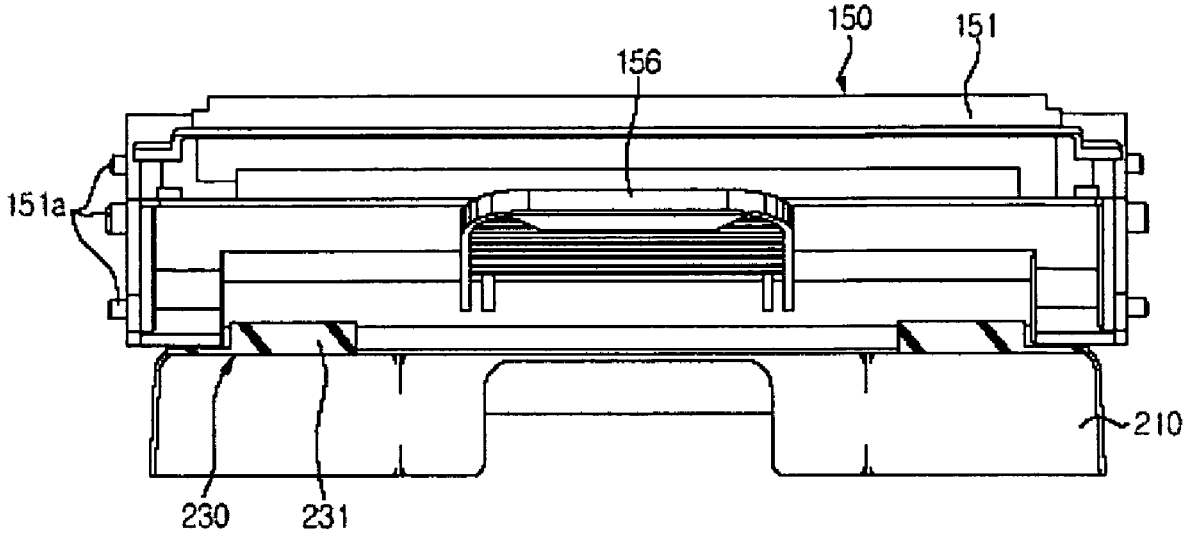
FIG. 5 is an elevation view showing an example of a guide unit of a developing unit formed on the recording medium cover of an image forming apparatus according to an embodiment of the invention.

FIG. 5 is an elevational view showing an example of a guide unit of a developing unit formed on the recording medium cover of an image forming apparatus according to a first embodiment of the invention. As shown in FIG. 5, the guide projections 151 a are prominently formed at both sides of the cartridge 151 that forms the developing unit 150. The guide unit 230 to guide mounting operations of the developing unit 150 is provided on the top surface of the recording medium cover 210. The guide unit 230 comprises at least one guide rib 231 formed in a shape that corresponds to a shape of a bottom surface of the cartridge 151. The guide rib 231 is formed at both sides of the recording medium cover 210 and guides the cartridge 151 relatively stably. The shape of the guide rib 231 allows a portion of the guide rib 231 to be fitted into the bottom surface of the cartridge 151 so as to align the location of the developing unit 150. The guide rib 231 may comprise two steps corresponding to the bottom surface of the cartridge 151.

Figure 6A:
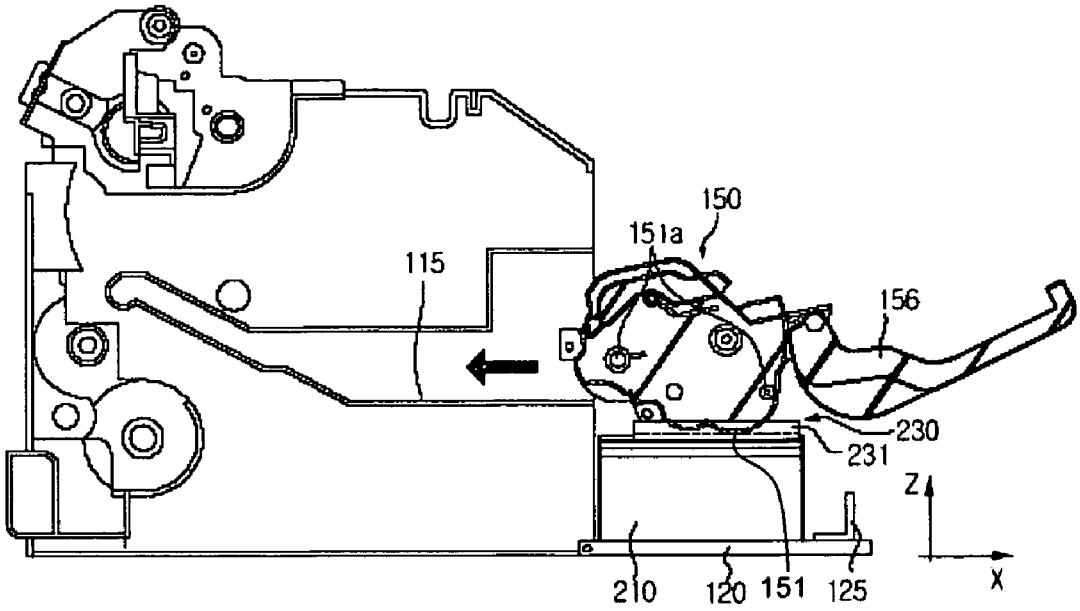
FIGS. 6A to 6C are views showing mounting procedures of a developing unit of an image forming apparatus according to the embodiment of the invention of FIG. 5.
Figure 6B:
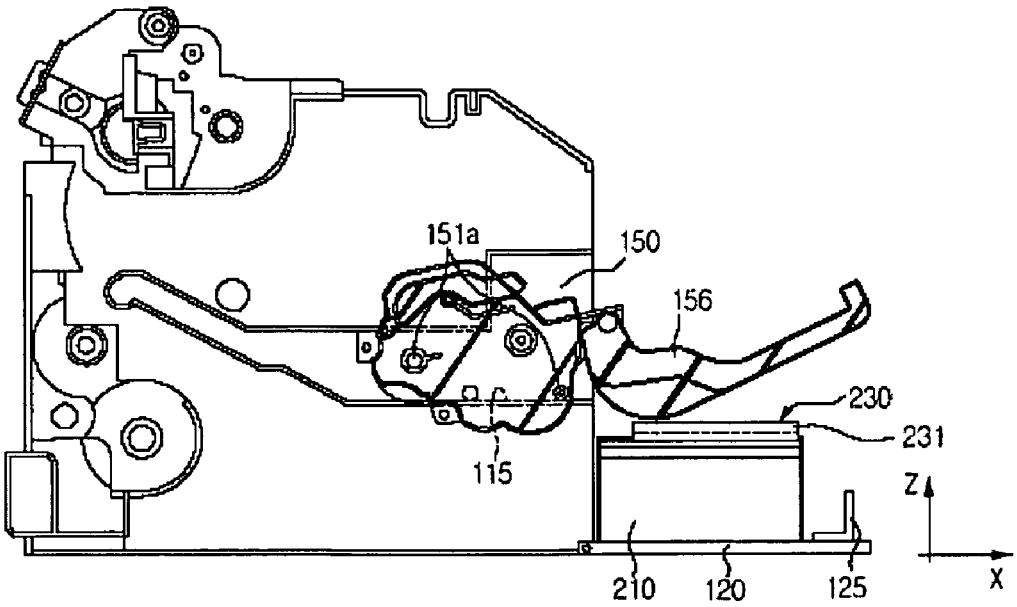
Figure 6C:
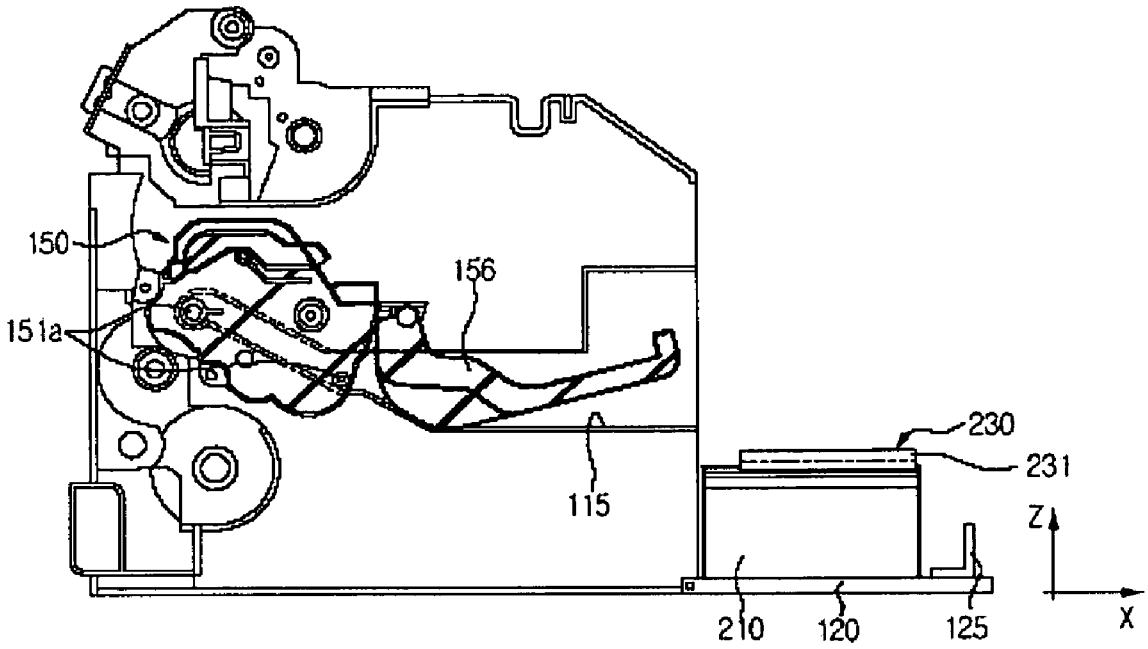

Hereafter, procedures to mount a developing unit 150 on the main body 110 are explained in accordance with the configuration described above. FIGS. 6A to 6C are views to show various stages of the mounting procedures.

First, referring to FIG. 6A, the developing unit 150 is placed onto the recording medium cover 210. At this point, the guide rib 231 of the guide unit 230, formed on the top surface of the recording medium cover 210, is fitted into the bottom surface of the cartridge 151. Accordingly, a location of the developing unit 150 is aligned so that the guide projections 151*a* provided at both sides of the cartridge 151 are correctly guided towards guide rails 115 formed at both sides within the main body 110.

Referring to FIG. 6B, if a user holds the handle 156 of the developing unit 150 and pushes the developing unit 150 into the main body 110, the cartridge 151 rides the guide rib 231 and is smoothly guided onto the guide rails 115 formed at both sides within the main body 110, whereby the guide projections 151*a* provided at both sides of the cartridge 151 slide along the guide rails 115.

Referring to FIG. 6C, the cartridge 151 is mounted on the main body 110 when the cartridge 151 is completely inserted in the main body 110. As such, the cartridge is provided in a ready state to perform development operations.

Second Embodiment

In the above description, an example of the guide unit 230 that is formed at the recording medium cover 210 is explained. However, the guide unit 230 may also be formed at the location of the recording medium width guide 127.

Figure 7:
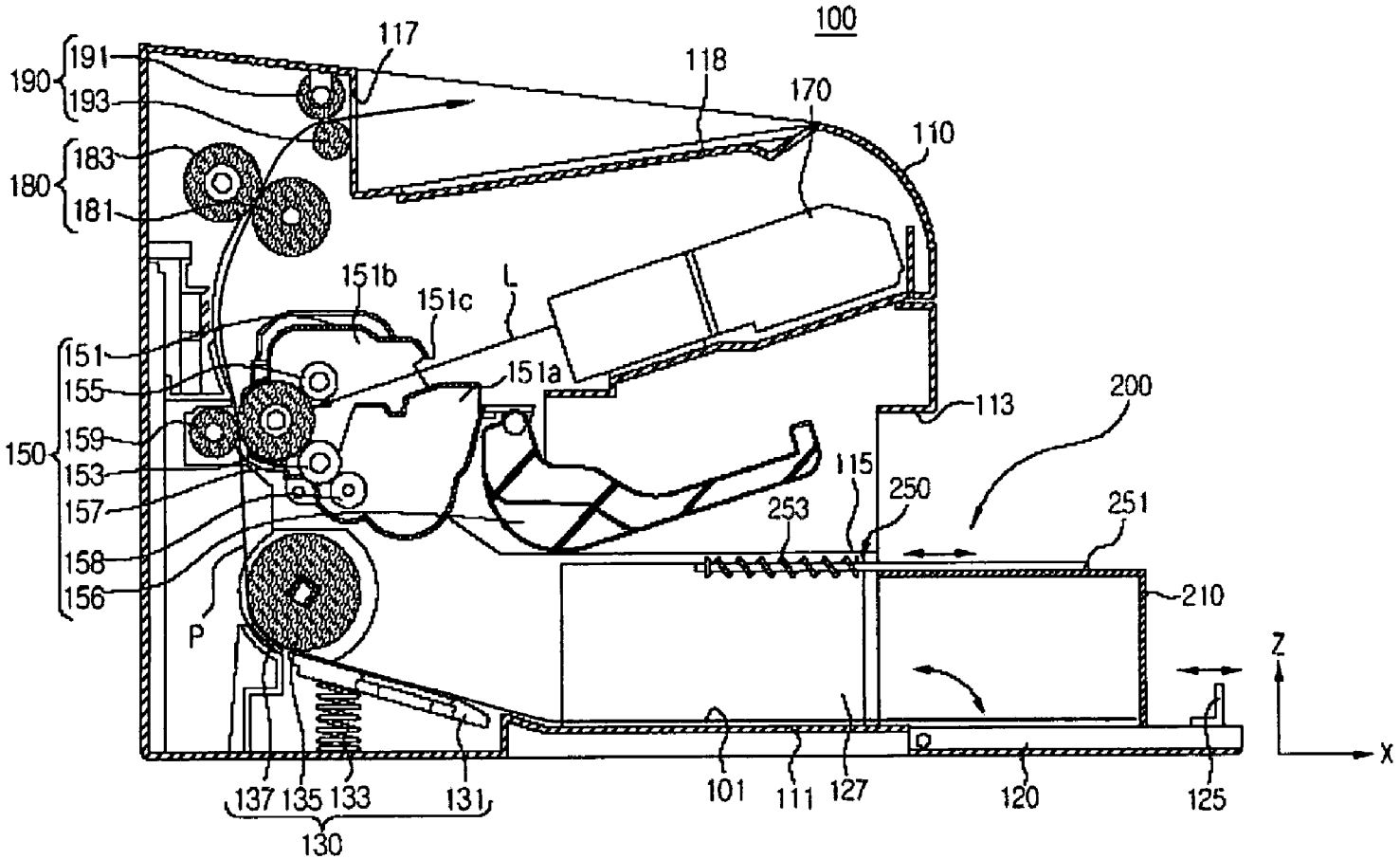
FIG. 7 is a vertical cross-sectional view showing a configuration of an image forming apparatus according to another embodiment of the invention.

FIG. 7 is a vertical cross-sectional view showing a configuration of an image forming apparatus according to a second embodiment of the invention. The same symbols as those of FIG. 6 are used for the same portions as those of FIG. 6, and will not be explained in detail. As shown in FIG. 7, the difference from FIG. 6 is that the guide unit 250 is formed at the recording width guide 127.

The guide unit 250 is formed as a guide bar 251 that is installed at the recording medium width guide 127 to guide the movement of the developing unit 150. The guide bar 251 is installed so as to be elastically biased by an elastic member 253. That is, if the recording medium feed cover 120 is opened, the guide bar 251 protrudes outwardly from the main body 110 through the opening 113 by the elastic force of the elastic member 253. On the other hand, if the recording medium feed cover 120 is closed, the guide bar 251 retracts into the main body 110, and the elastic member 253 is compressed. According to the embodiment of the invention, the elastic member 253 comprises a coil spring. The top surface of the guide bar 251 is shaped to correspond to a shape of the bottom surface of the cartridge 151 that forms the developing unit 150 in a similar manner as that of the guide rib 231 of the first embodiment.

Figure 8A:
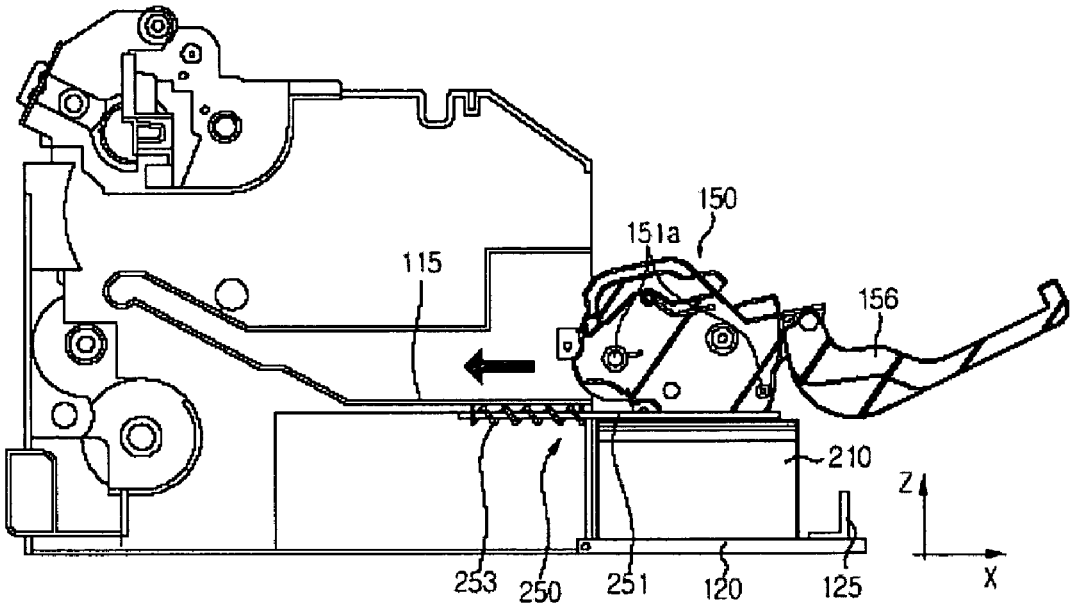
FIGS. 8A to 8C are views showing mounting procedures of a developing unit of an image forming apparatus according to the embodiment of the invention of FIG. 7.
Figure 8B:
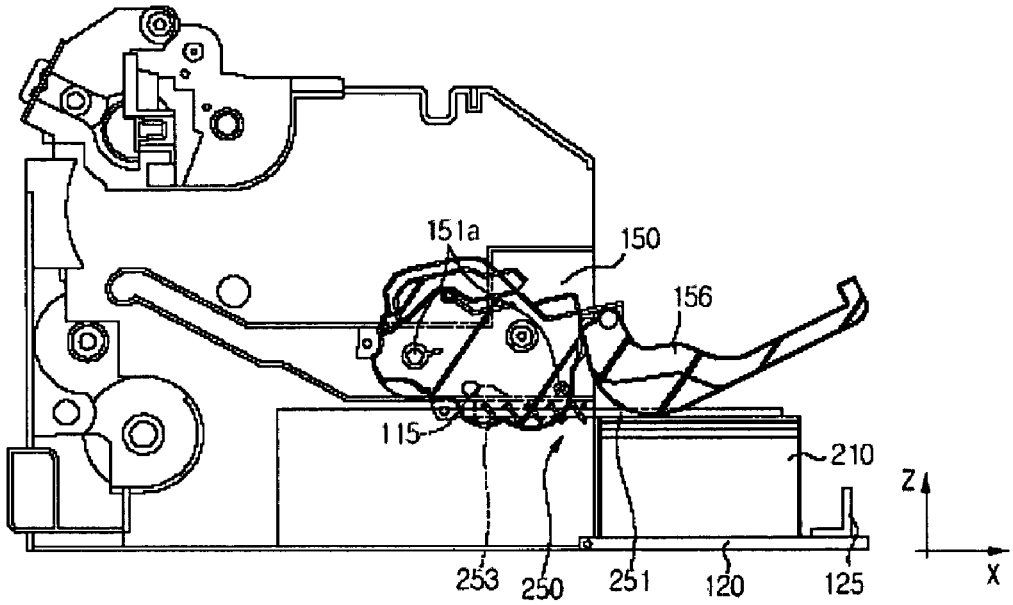
Figure 8C:
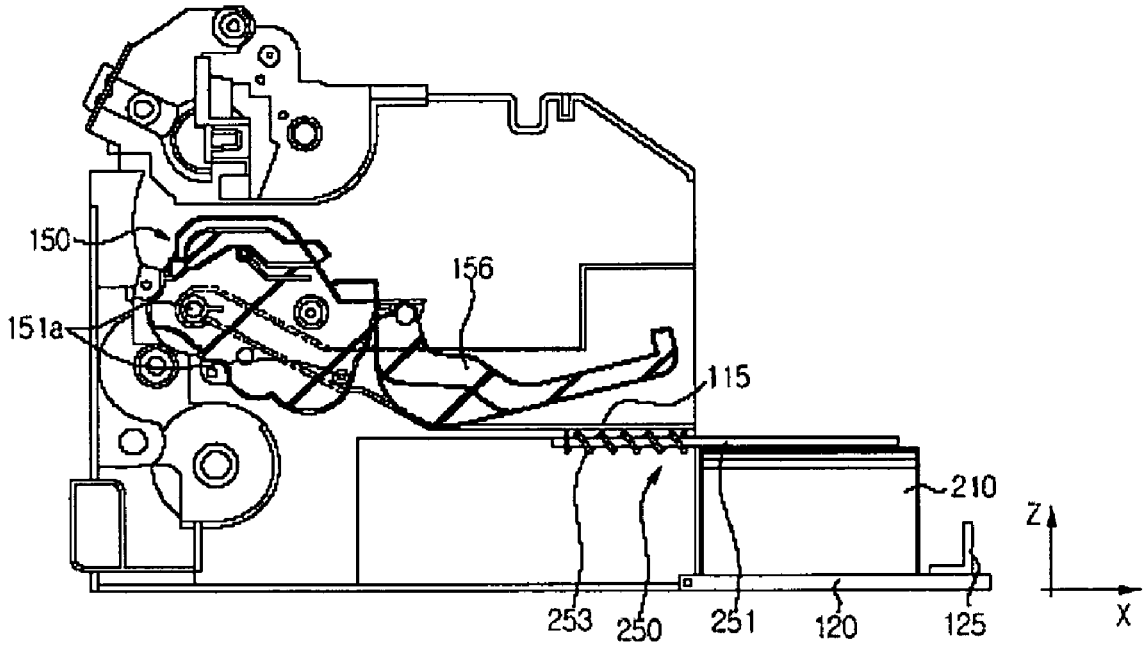

Hereafter, procedures to mount a developing unit 150 using the guide bar 251 are explained in accordance with the configuration described above. FIGS. 8A to 8C are views showing various stages of the mounting procedures.

First, referring to FIG. 8A, the developing unit 150 is placed onto the recording medium cover 210. The guide bar 251 protrudes outwardly from the main body 110 through the opening 113 due to the elastic force of the elastic member 253, and the bottom surface of the cartridge 151 that forms the developing unit 150 contacts the top surface of the guide bar 251. At this point, the guide bar 251 is fitted into the bottom surface of the cartridge 151 and aligns the mount location of the cartridge 151. In other words, the location of the cartridge 151 is aligned so that the guide projections 151 a provided at both sides of the cartridge 151 are correctly inserted into the guide rails 115 formed at both sides within the main body 110.

Hereafter, referring to FIG. 8B, if a user holds the handle 156 of the developing unit 150 and pushes the developing unit into the main body 110, the cartridge 151 rides the guide bar 251 and is smoothly guided onto the guide rails 115 formed at both sides within the main body 110, whereby the guide projections 151*a* provided at both sides of the cartridge 151 slide along the guide rails 115.

Referring to FIG. 8C, the cartridge 151 is mounted on the main body 110 when the cartridge 151 is completely inserted in the main body 110. As such, the cartridge is provided in a ready state to perform development operations.

As is described above, according to aspects of the invention, an image forming apparatus 100 is provided in which the recording medium feed cover 120 opens and closes the opening 113 of the main body 110, and the developing unit 150 is mounted and dismounted through the opening 113. However, embodiments of the invention are not limited to this example, and the guide unit and the developing unit described above may be applied to various types of image forming apparatuses that may be mounted with and dismounted from the developing unit 150.

An image forming apparatus that is structured such that a developing unit is dismounted from the main body and again mounted on the main body, as described above, is advantageous in that a developing unit may be correctly aligned with the mount location and is guided so as to be carried inside the main body.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus to form an image on a recording medium transferred through the apparatus, comprising:

a main body to define an opening;

a developing unit to be mounted into and dismounted from the main body through the opening, to form the image on the recording medium;

a recording medium feed cover to open and close the opening, the recording medium feed cover comprising a top surface on which the recording medium is stacked;

a recording medium cover installed on the recording medium feed cover, to cover the recording medium stacked on the recording medium feed cover; and a guide unit, provided on the recording medium cover, to guide a mounting location of the developing unit.

2. The apparatus as claimed in claim 1, wherein the guide unit comprises at least one guide rib to contact a bottom surface of the developing unit.

3. The apparatus as claimed in claim 2, wherein the guide rib is plural in number and is formed symmetrically along a widthwise direction of a top surface of the recording medium cover.

4. The apparatus as claimed in claim 2, wherein a shape of a top surface of the guide rib corresponds to a shape of a bottom surface of the developing unit.

5. The apparatus as claimed in claim 1, wherein the guide unit is detachably installed.

6. An image forming apparatus to form an image on a recording medium transferred through the apparatus, comprising:

a main body to define an opening;

a developing unit to be mounted into and dismounted from the main body through the opening, to form the image on the recording medium;

a recording medium feed cover to open and close the opening, the recording medium feed cover comprising a top surface on which the recording medium is stacked;

a recording medium width guide, installed on at least one interior side of the main body, to align the recording medium widthwise; and a guide unit, installed at the recording medium width guide, to guide a mounting location of the developing unit.

7. The apparatus as claimed in claim 6, wherein the guide unit comprises a guide bar installed at an upper portion of the recording medium width guide to guide a movement of the developing unit.

8. The apparatus as claimed in claim 7, further comprising an elastic member to elastically bias the guide bar toward an exterior of the main body when the recording medium feed cover is opened.

9. The apparatus as claimed in claim 8, wherein the elastic member comprises a coil spring.

10. The apparatus as claimed in claim 6, wherein a top surface of the guide bar is formed so as to correspond to a bottom surface of the developing unit.

11. An image forming apparatus to form an image on a recording medium transferred through the apparatus, comprising:

a main body to define an opening;

a developing unit to be mounted into and dismounted from the main body through the opening, to form the image on the recording medium;

a recording medium feeding unit to feed the recording medium toward the developing unit; and a guide unit, installed at a recording medium width guide, to guide a mounting location of the developing unit.

12. An image forming apparatus to form an image on a recording medium transferred through the apparatus, comprising:

a main body to define an opening;

a developing unit to be mounted into and dismounted from the main body through the opening, to form the image on the recording medium;

a recording medium feed cover to open and close the opening, the recording medium feed cover comprising a top surface on which the recording medium is stacked; and a guide unit, installed on the recording medium feed cover, outside the main body, to guide a mounting location of the developing unit.

13. The apparatus as claimed in claim 12, wherein the guide unit is detachably installed.

14. An image forming apparatus to form an image on a recording medium transferred through the apparatus, comprising;

a main body to define an opening;

a developing unit to be mounted into and dismounted from the main body through the opening, to form the image on the recording medium;

a recording medium feed cover to open and close the opening, the recording medium feed cover comprising a top surface on which the recording medium is stacked; and a guide unit, installed so as to be selectively protruded from the inside to the outside of the main body and onto the recording medium feed cover, to guide a mounting location of the developing unit.

15. The apparatus as claimed in claim 14, wherein the guide unit is detachably installed.

16. An image forming apparatus, having a main body to define an opening, to form an image on a recording medium transferred through the apparatus, the opening being opened and closed by a cover unit on which the recording medium is stacked, the apparatus comprising:

a developing unit to be mounted in the main body through the opening, to form the image on the recording medium, the developing unit including a lower surface having a first shape;

a guide unit, provided on a top surface of the cover unit, with the recording medium stacked therebetween, to guide the mounting of the developing unit from a position at which the developing unit sits atop the guide unit, the guide unit having a second shape to oppositely correspond to the first shape.

17. The apparatus according to claim 16, wherein, when the developing unit sits atop the guide unit, a substantially straight external force moves the developing unit from atop the guide unit to a mounted position in the main body.

18. The apparatus according to claim 16, further comprising guide projections formed at both sides of the developing unit.

19. The apparatus according to claim 16, wherein the guide unit comprises at least one guide rib formed symmetrically along a widthwise direction of a top surface of the guide unit.

20. An image forming apparatus, having a main body to define an opening, to form an image on a recording medium transferred through the apparatus, the opening being opened and closed by a cover unit on which the recording medium is stacked, the apparatus comprising:

a developing unit to be mounted in the main body through the opening, to form the image on the recording medium, the developing unit including a lower surface having a first shape;

a guide unit, provided on a top surface of the cover unit above the recording medium, to guide the mounting of the developing unit from a position at which the developing unit sits atop the guide unit, the guide unit having a second shape to oppositely correspond to the first shape, wherein the guide unit comprises a guide bar that is elastically biased to protrude out from the main body when the cover unit opens the opening.

21. An image forming apparatus, having a main body to define an opening, to form an image on a recording medium transferred through the apparatus, the opening being opened and closed by a cover unit on which the recording medium is stacked, the apparatus comprising:

a developing unit to be mounted in the main body through the opening, to form the image on the recording medium, the developing unit including a surface having a first shape;

a guide unit having a second shape to oppositely correspond to the first shape, provided on the cover unit with the recording medium stacked therebetween, to guide the mounting of the developing unit from a position at which the surface of the developing unit cooperates with the guide unit.

* * * * *